United States Patent [19]

Van Raaij

[11] Patent Number: 4,601,631

[45] Date of Patent: Jul. 22, 1986

[54] UNLOADING SYSTEM FOR STREET SWEEPER

[76] Inventor: K. W. M. Van Raaij, 1800 AG Alkmaar, Netherlands

[21] Appl. No.: 579,162

[22] Filed: Feb. 10, 1984

[51] Int. Cl.[4] ..... B60P 1/36

[52] U.S. Cl. ..... 414/509; 15/256.5; 198/497; 198/499; 298/1 B; 414/539; 414/527

[58] Field of Search ..... 414/304, 509, 539, 527; 298/1 B; 198/497, 499

[56] References Cited

U.S. PATENT DOCUMENTS 2,298,747 10/1942 Agar ..... 414/509
3,994,388 11/1976 Reiter ..... 198/499

FOREIGN PATENT DOCUMENTS 1217872 5/1966 Fed. Rep. of Germany ..... 414/539
18520 2/1979 Japan ..... 414/539

*Primary Examiner*—Frank E. Werner
*Attorney, Agent, or Firm*—Rogers, Howell, Moore & Haferkamp

[57] ABSTRACT

A motorized vehicular vacuum street sweeper (2) has a hopper (12) for receiving suctioned debris and includes unloading devices (36) provided by a flexible sheet-like wrapper (38) in the hopper forming a receptacle cavity (76). The wrapper is flexed by actuation devices (74) to shrink the cavity and expel debris through an exit door (40) in the hopper.

1 Claim, 5 Drawing Figures

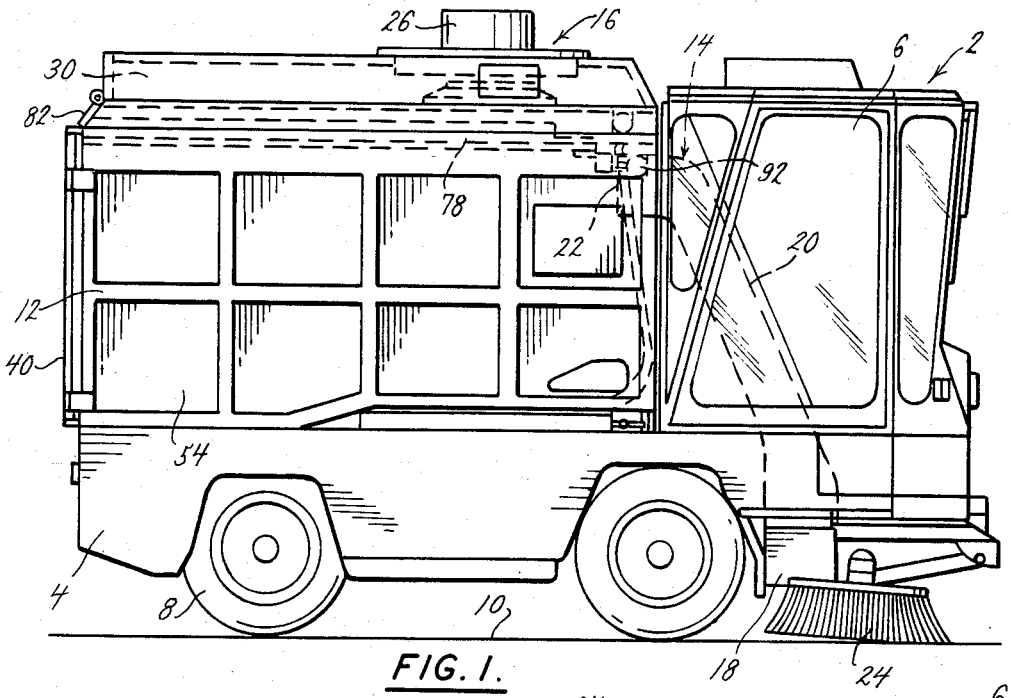
FIG. 1.
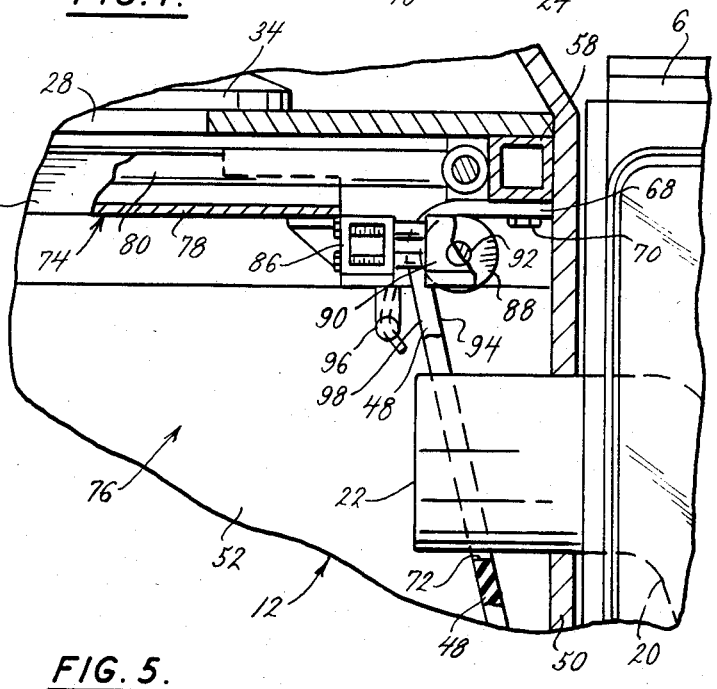
FIG. 4.
FIG. 5.
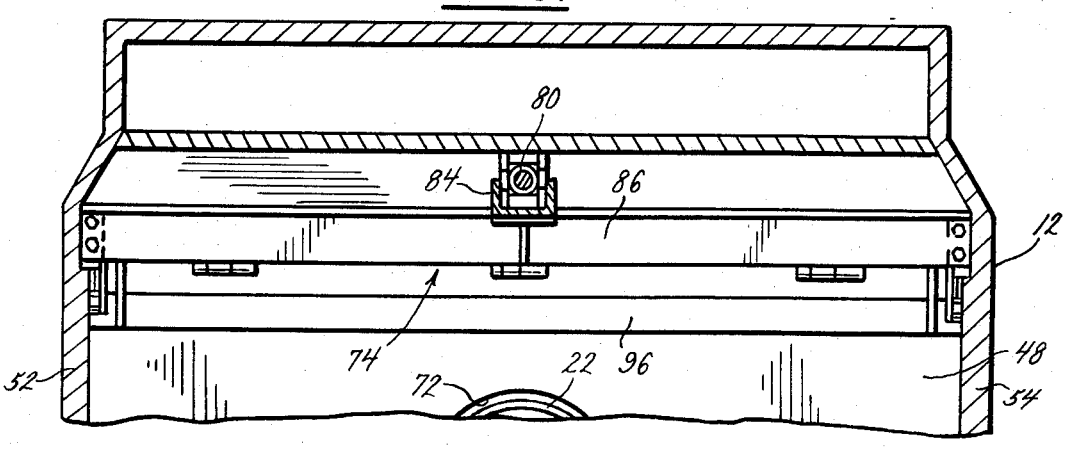

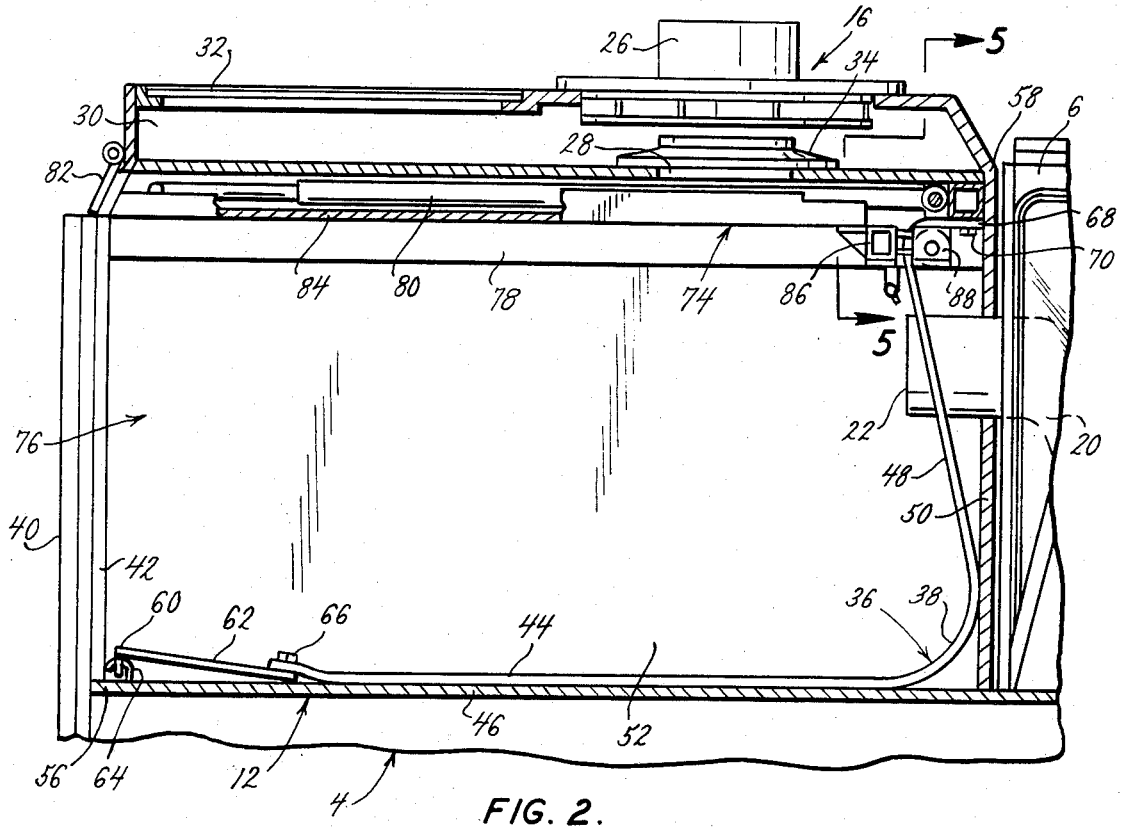
FIG. 2.
FIG. 3.
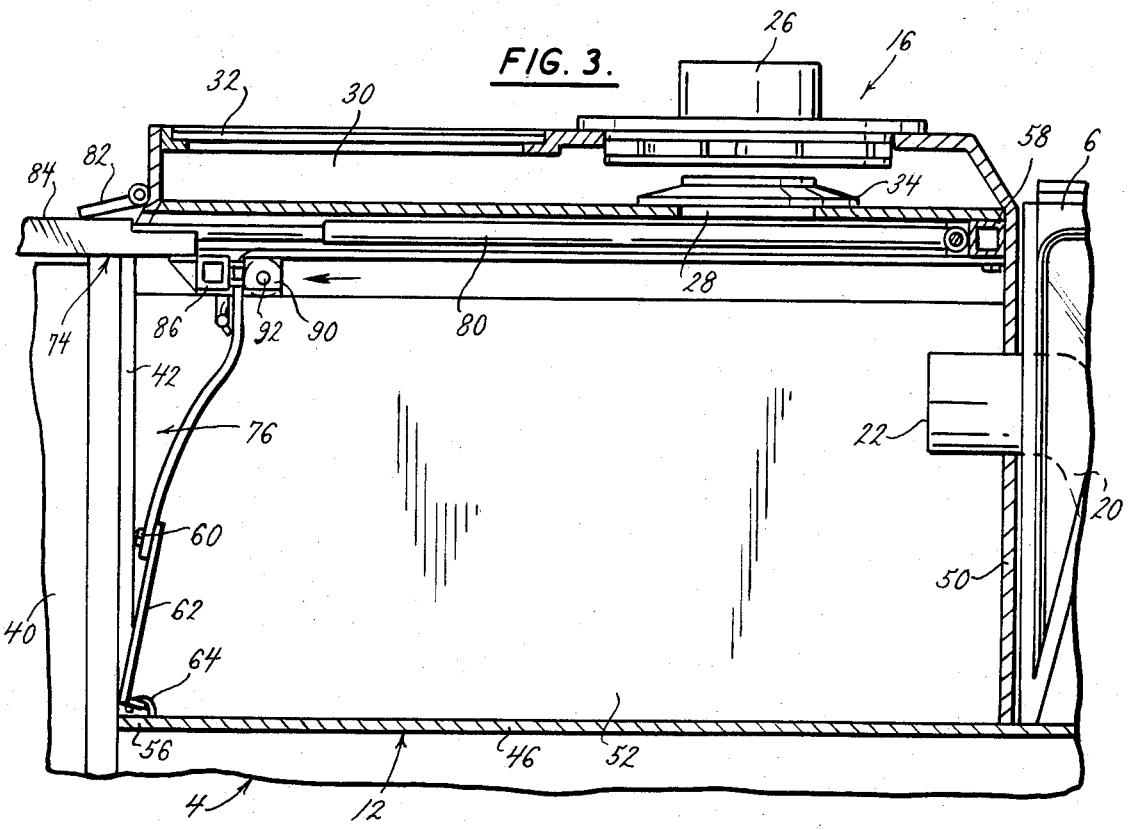

UNLOADING SYSTEM FOR STREET SWEEPER

BACKGROUND AND SUMMARY

This invention relates to an unloading system for a sweeper of the motorized vehicular type having a hopper for receiving debris and means such as a vacuum system for suctioning debris and depositing same in the hopper. The invention is particularly related to an unloading system for expelling debris that has collected within the hopper.

Known street sweepers unload dirt and debris after collection by tipping the hopper, or by raising a false floor inside the hopper while opening a door at the side, or by dumping the debris on the ground through a trapped door in the floor of the hopper. The first two types of unloading systems adversely affect load balance on the sweeper during unloading. The third type of system requires a dedicated area of the undercarriage to be free of other vehicle components, and also results in a ground pile of dirt and debris over which the vehicle drives, which may damage the vehicle tires.

The present invention addresses and solves the above noted and other problems. The invention affords a large capacity street sweeper which is compact and lightweight. A street sweeper in accordance with the present invention offers a high load capacity equal to that of previous large sweepers, yet of significant reduction in weight and dimensional size.

The compact size of the present street sweeper is facilitated by an unloading system comprising a flexible wrapper in the hopper that has a horizontal portion that normally lies upon the bottom of the hopper and an upright portion that normally is held adjacent the front wall of the hopper, with a carriage that progressively transfers the horizontal portion from the bottom to the top of the hopper by way of the upright portion, having the effect of transferring the upright portion from the front to the rear of the hopper. By this means, the wrapper is deformed upon flexure to shrink the cavity and expel debris through an exit door at the rear of the hopper.

A balanced unloading system is afforded without the need for a dedicated undercarriage area free of other components. This facilitates compactness of the sweeper by enabling, for example, the engine and transmission to be mounted below the hopper.

BRIEF DESCRIPTION OF THE DRAWINGS

FIG. 1 is a side elevation view of a street sweeper incorporating an unloading system in accordance with the invention.

FIG. 2 is an enlarged longitudinal sectional view of the upper rear portion of FIG. 1 showing the hopper cavity in section and in a debris-receiving condition.

FIG. 3 is a view like that of FIG. 2 but showing the hopper cavity in a discharged condition.

FIG. 4 is a further enlarged sectional view of the upper front portion of the hopper as shown in FIG. 2.

FIG. 5 is a further enlarged cross sectional view taken along Line 5—5 of FIG. 2.

DETAILED DESCRIPTION

There is shown in FIG. 1 a street sweeper 2 of the motorized vehicular type including a frame or chassis 4 and operator cab 6 supported on wheels 8 on street surface 10. Hopper 12 receives collected debris. Means 14 is provided for depositing debris in the hopper and may include a vacuum system 16 for suctioning debris at intake nozzle 18 and transmitting same through intake tube 20 for deposit in hopper 12 at inlet port 22. A pair of rotating brooms 24 direct and funnel dirt and debris toward central suction nozzle 18. Vacuum blower 26, FIGS. 1 and 2, creates suctioning vacuum in hopper 12 through port 28. Blower 26 draws air from port 28 and directs it through exhaust passage 30 and out exhaust port 32, which creates the vacuum upwardly through port 28 and flange cover 34 into exhaust passage 30.

Debris unloading means 36 is provided by a flexible wrapper 38 in the hopper deformable to expel and discharge debris and fine dirt through an exit door 40 in the hopper 12, preferably in the rear side wall 42 thereof. Flexible wrapper 38 is a sheet-like member preferably formed of rubber or nylon reinforced PVC as a rubber mat or the like. The wrapper or sheet-like member 38 extends at a bottom portion 44 along the bottom wall 46 of the hopper 12, and then upwardly at portion 48 proximate the front side wall 50 of the hopper 12 to define a receptacle chamber or cavity 76 in the hopper. Wrapper 38 is deformed by moving upwardly extending portion 48 toward exit door 40, FIG. 3. Bottom portion 44 of the wrapper 38 progressively flexes upwardly as portion 48 moves toward the exit door 40 to shrink the receptical cavity 76 and expel debris.

Wrapper 38 extends laterally between left and right opposing side walls 52 and 54 of the hopper, FIG. 5. Wrapper 38 extends longitudinally from lower rear corner 56 of the hopper 12, FIG. 2, along bottom wall 46 and front wall 50 to upper front corner 58 of the hopper. The receptacle cavity 46 is between left and right side walls 52 and 54 and between rear side wall 42 of the hopper 12 and upwardly extending wrapper portion 48. The wrapper 38 is anchored at its lower end 60 to the hopper 12, preferably by a metal plate section 62 hooked to the hopper corner at 64 and secured to wrapper portion 44 by a laterally extending bolted template 66 or the like. The upper end 68 of the wrapper 38 is rigidly secured to hopper corner 58 by a bolted lateral template 70 of the like. Inlet port 22 in front side wall 50 of the hopper 12 extends through an aperture 72, FIG. 4, in wrapper 38, such that the hopper receives debris therethrough.

Actuation means 74 are provided for flexing wrapper 38 to shrink the cavity 76 and expel debris through exit door 40. FIG. 2 shows cavity 76 in its expanded condition, and FIG. 3 shows cavity 76 in its shrunken condition. Wrapper 38 is flexed to move rearwardly to shrink the cavity rearwardly thereof. Actuation means 74 includes a carriage 78, FIG. 4, moveable by hydraulic piston 80 rearwardly toward the exit door 40. The hydraulic piston 80 and carriage 78 move rearwardly through hinged door 82, FIG. 3, and project beyond the rear end of the sweeper in the extended rearward position. The front end (right end as viewed in FIG. 3) of the hydraulic cylinder is anchored against upper front hopper corner 58. The carriage includes a central longitudinal channel beam 84 secured at its rearward end (left end as viewed in FIG. 2) to the end of the hydraulic piston, and a lateral cross beam 86 secured to the front end (right end as viewed in FIG. 4) of beam 84. A laterally extending roller 88 is mounted to lateral cross beam 86 of the carriage 78 and moves therewith along the ceiling of the hopper 12. Roller 88 is mounted forwardly of cross beam 86 by forwardly extending journals such as 90 at the lateral ends of the cross beam 86 which receive the laterally extending trunnions 92 at the ends of the roller 88 in journaled relation and allow the roller 88 to rotate about a lateral axis. Portion 48 of wrapper 38 extends between roller 88 and cross bar 86 such that the roller 88 engages the outside surface 94 of the wrapper 38 externally of cavity 76. Rearward movement of carriage 78 pulls roller 88 rearwardly along outside surface 94 of the wrapper 38 to push the wrapper 38 against the hopper ceiling, FIG. 3. The wrapper 38 flexes and traverses across roller 88 and is pulled by the latter toward the exit door 40. A laterally extending scraper bar 96 is mounted to the underside of the carriage along cross bar 86 to engage the inside surface 98 of the wrapper 38 to scrape debris therefrom during unloading.

It is recognized that various modifications are possible within the scope of the appended claims.

I claim:

1. An unloading system for discharging debris from a hopper wherein the hopper has substantially parallel side walls, a front wall, a rear wall and a floor, means to open the rear wall to allow discharge of the debris, a sheet-like member extending over substantially the entire span between the side walls of the hopper, the sheet-like member having a forward edge and a rearward edge, the forward edge being connected to the hopper adjacent the top of the front wall, the rearward edge being connected to the hopper adjacent the intersection between the floor and the rear wall, a carriage comprising a rigid beam extending transversely of the hopper between the side walls adjacent the tops thereof, a roller parallel to and supported by the beam adjacent the lateral ends thereof, a longitudinally extending hydraulic actuator having a piston and cylinder one of which is connected to the center of the beam and the other of which is connected to the hopper so that operation of the hydraulic actuator in a first direction moves the carriage rearwardly and operation of the hydraulic actuator in a second direction moves the carriage forwardly, the sheet-like member extending across the top and rear surfaces of the roller and having a first portion extending generally horizontally from the front edge of the sheet-like member to the roller, a second portion hanging generally vertically from the roller to the floor, and a third portion extending across the floor from the second portion to the rearward edge of the sheet-like member, whereby movement of the carriage rearwardly of the hopper progressively increases the length of the first portion and progressively decreases the length of the third portion thereby transferring the second portion toward the rear of the hopper to expel debris therefrom, the roller being forward of the beam, a scraper supported by the carriage on the rearward side of the roller, the scraper extending laterally to engage the surface of the sheet-like member and scrape debris therefrom during rearward movement of the carriage.

* * * * *